US005988750A

United States Patent [19]

Rubottom

[11] Patent Number: 5,988,750

[45] Date of Patent: Nov. 23, 1999

[54] SUBSTANTIALLY NON-FREESTANDING BACKREST

[76] Inventor: Robert H. Rubottom, 1881 Russet Dr., Eugene, Oreg. 97401

[21] Appl. No.: 09/026,735

[22] Filed: Feb. 20, 1998

[51] Int. Cl.[6] ..... A47C 1/14

[52] U.S. Cl. ..... 297/350; 297/351; 297/16.2; 297/17

[58] Field of Search ..... 297/350, 351, 297/377, 4, 16.2, 17, 22, 42, 45, 230.11, 391, 452.13

[56] References Cited

U.S. PATENT DOCUMENTS

| | | | |
|---|---|---|---|
| 337,715 | 3/1886 | Tietze | 297/17 |
| 1,209,808 | 12/1916 | Burgess . | |
| 1,238,782 | 9/1917 | Kaye | 297/230.11 |
| 1,312,774 | 8/1919 | Barrett | 297/351 |
| 1,363,697 | 12/1920 | Vieira . | |
| 1,584,448 | 5/1926 | Garnham | 297/351 |
| 1,696,362 | 12/1928 | Sewell | 297/351 |
| 1,842,424 | 1/1932 | Panten et al. . | |
| 4,605,261 | 8/1986 | Lee | 297/16.2 |
| 4,836,601 | 6/1989 | Cone | 297/16.2 |

FOREIGN PATENT DOCUMENTS

| | | | |
|---|---|---|---|
| 926195 | 7/1949 | Germany | 297/350 |
| 454569 | 1/1950 | Italy | 297/351 |
| 191650 | 1/1923 | United Kingdom | 297/350 |

*Primary Examiner*—Laurie K. Cranmer

[57] ABSTRACT

A substantially non-freestanding backrest for supporting a person in a reclining position. The rest assembly comprises a support structure of two preferably pivotally intersecting leg members having a torso support member coupled therebetween. A lower back support member and various supply holding configurations/embodiments are also disclosed.

12 Claims, 13 Drawing Sheets

SUBSTANTIALLY NON-FREESTANDING BACKREST

BACKGROUND OF THE INVENTION

1. Field of the Invention

The present invention relates to human reclining devices and, more specifically, to such devices that are lightweight, collapsible and economically made.

2. Description of Related Art

Beach goers, sunbathers and others engaging in recreational or leisure activities that necessitate sitting or resting on the ground or sand, frequently use mats, blankets or towels upon which to sit. Some people may attempt to carry with them, sometimes to remote locations, chairs for added comfort. Chairs used for this purpose are usually foldable in design to aid in such transportation but are nonetheless relatively heavy and bulky to carry.

Conventional folding or collapsible chair-like devices are frequently constructed of metal, wood or plastic materials. They are usually hinged or connected in a fashion to allow for folding into a single plane, usually requiring numerous movable components and connections. Commonly, they will employ some type of webbed or solid seat design, as well as a torso or upper body reclining support. While these devices may be comfortable, they are disadvantageous for many reasons including that they are relatively expensive to manufacture, bulky and difficult to carry for extended distances among other considerations.

Some folding chair-like devices are designed to collapse into a more compact bundle for carrying. Patents illustrating these devices include those issued to A. Le Voir, Belgium Pat. No. 502236 (1950), Otto David Mayer, Italian Pat. No. 615777 (1961), G. Tietze, U.S. Pat. No. 337,715 (1886), and R. W. Lynch, Jr., U.S. Pat. No. 5,499,857 (1996). While the devices disclosed in these patents fold or collapse into a compact bundle, they are generally disadvantageous in that they have numerous parts that increase the cost of manufacture, may result in a bulky transport package and typically require extra effort in assembly and setup.

There are some folding type backrest devices designed to provide only back or torso support and allow the user to sit directly on or be supported by the ground or sand. Patents illustrative of these types of reclining devices include those issued to J. S. & O. W. Ponten, U.S. Pat. No. 1,842,424 (1928), J. J. Vieira, U.S. Pat. No. 1,363,697 (1920) and C. V. Burgess, U.S. Pat. No. 1,209,808 (1916). The reclining devices disclosed in these patents allow the user to recline while being supported by the ground, but are similarly disadvantageous in that they utilize numerous parts and tend to be unnecessarily costly, bulky and complicated to use.

While prior art chairs and backrest devices have contributed to the art, a need continues to exist for a lightweight, compact and comfortable, foldable backrest that is inexpensive to manufacture and convenient to store, transport, assemble and use.

OBJECTS AND SUMMARY OF THE INVENTION

Accordingly, it is an object of this invention to provide a reclining backrest which collapses into a compact and easy to carry bundle.

It is another object of this invention to provide a reclining backrest that is lightweight and convenient to carry and transport.

It is another object of this invention to provide a reclining backrest that is easy to assemble for use and disassemble for storage.

It is another object of this invention to provide a reclining backrest that will deliver comfort, structural stability and durability and support to a wide range of users.

It is another object of this invention to provide a reclining backrest that is inexpensive to manufacture and may be utilized in a wide range of recreational or leisure time activities.

These and related objects of the present invention are achieved by use of a substantially non-freestanding backrest as described herein. In one embodiment, the present invention includes a backrest member configured to receive at least a portion of a back of a person in the sitting or reclining position and a support structure to which said backrest member is coupled that includes a bottom and a top and supports said backrest member when in use.

The support structure is configured to be substantially non-freestanding and support is provided by virtue of placing said bottom in or on a substance where movement is impeded and having a user lean back against the backrest member. The backrest member is preferably releasably coupled to said support structure. The apparatus may also include a member for providing lower back support and this member may be releasable.

Another embodiment of the present invention includes first and second legs substantially in an intersecting arrangement when in use and a back support member configured substantially as a strip coupled between said first and second legs. A lower back support member that is releasably attached to said backrest member may also be provided.

The attainment of the foregoing and related advantages and features of the invention should be more readily apparent to those skilled in the art, after review of the following more detailed description of the invention taken together with the drawings.

DETAILED DESCRIPTION OF PREFERRED EMBODIMENT

Figures 1A, 1B, 1C:
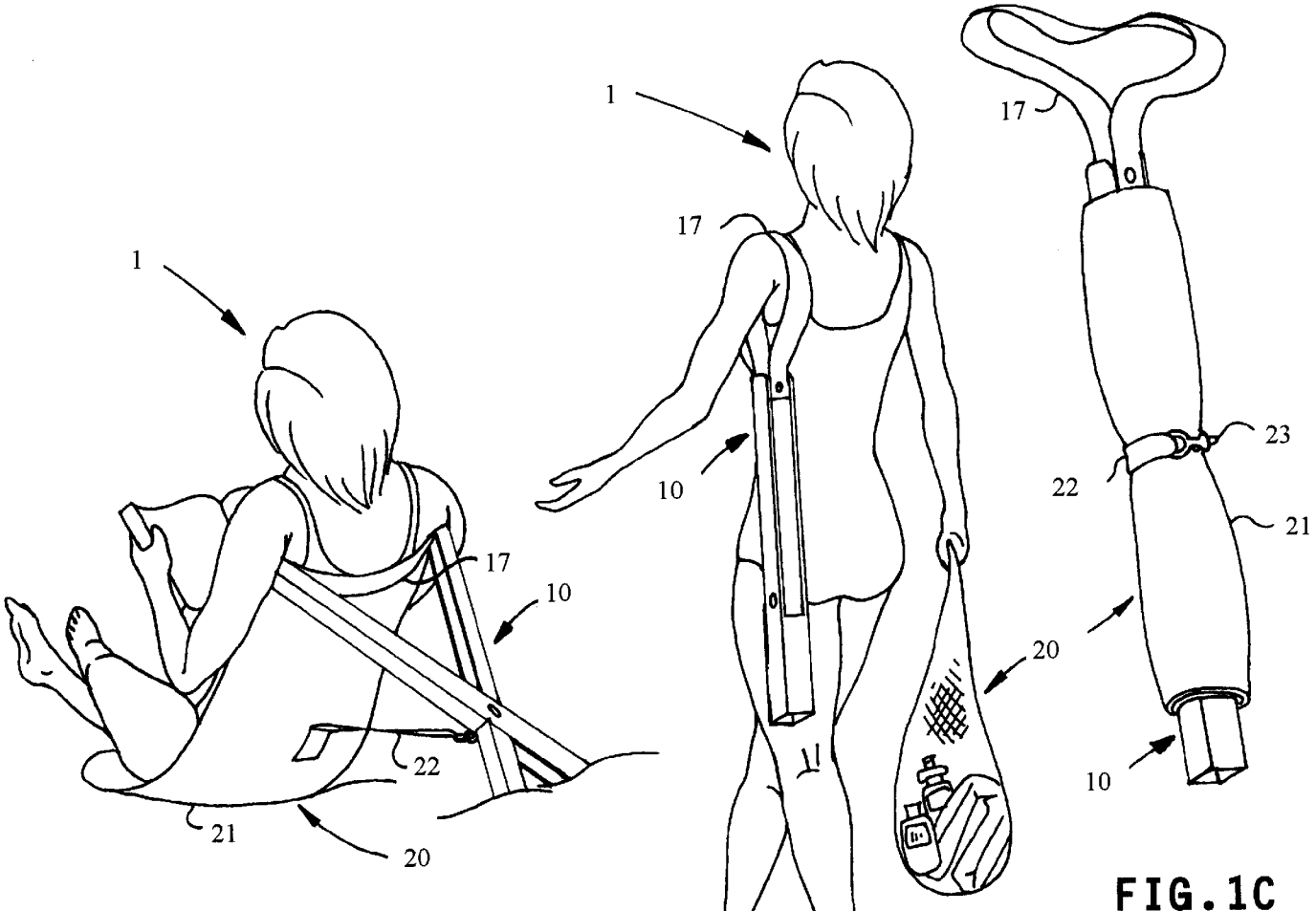
FIGS. 1A–1C are perspective views of a backrest in use, carried in the collapsed position and in an alternative collapsed position respectively in accordance with the present invention.
Figure 16:
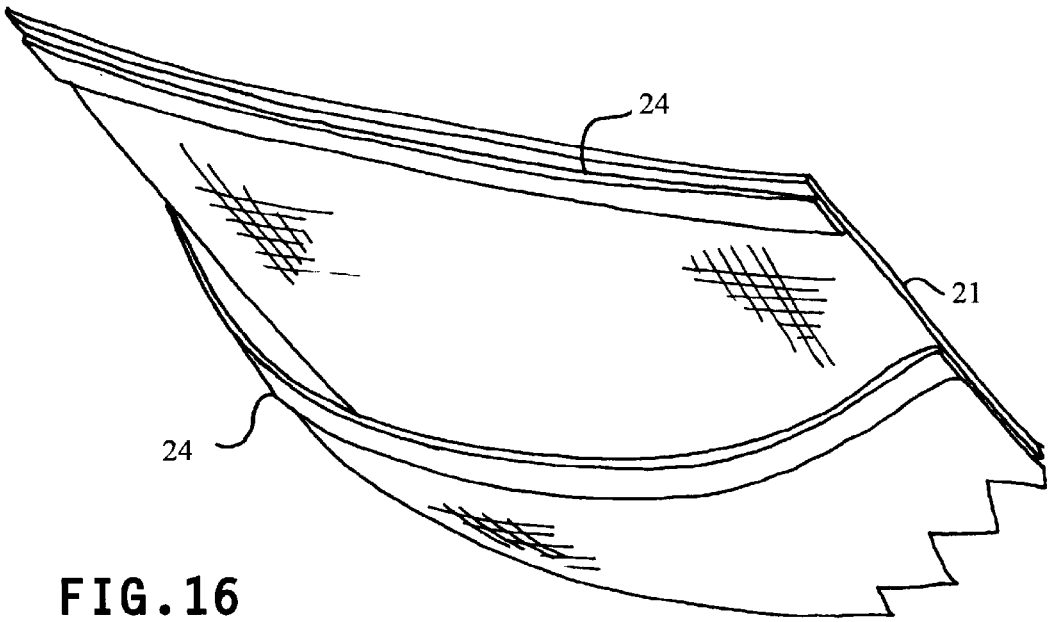
FIG. 16 is a prospective view of the tote bag function of a backrest lower back support assembly in accordance with the present invention.

Referring to FIG. 1A, a backrest or rest assembly 10 in accordance with the present invention is shown. Utilizing an optional lower back support assembly 20 (that releasable connects to torso support 17), user 1 is shown seated directly on an attached lower back support material 21, that is attached with a connection strap 22. FIG. 1B shows user 1 transporting rest assembly 10 by use of a torso support 17, as disused in more detail below with reference to FIGS. 2A and 2B, among others. Accessory items such as sunbathing supplies may be carried within the multi-layered, tote bag feature of lower back support assembly 20 (illustrated in FIG. 16). FIG. 1C depicts a completely closed rest assembly 10 wrapped with optional lower back support material 21. The arrangement of FIG. 1C is secured with connection strap 22 and a connector 23 ready for transport and storage.

Figure 2A:
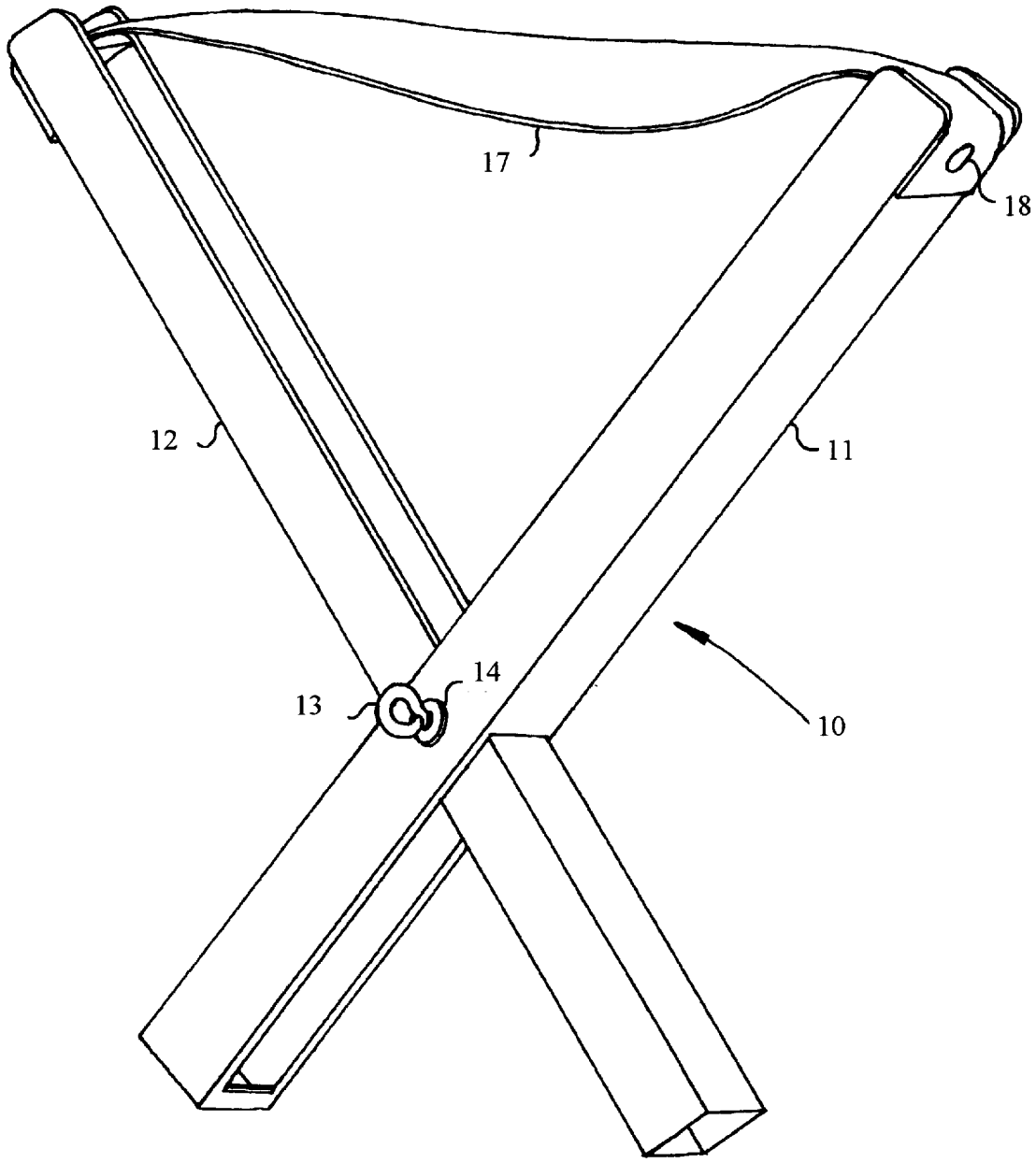
FIGS. 2A and 2B are perspective views of a backrest in the employed and collapsed positions respectively in accordance with the present invention.
Figure 2B:
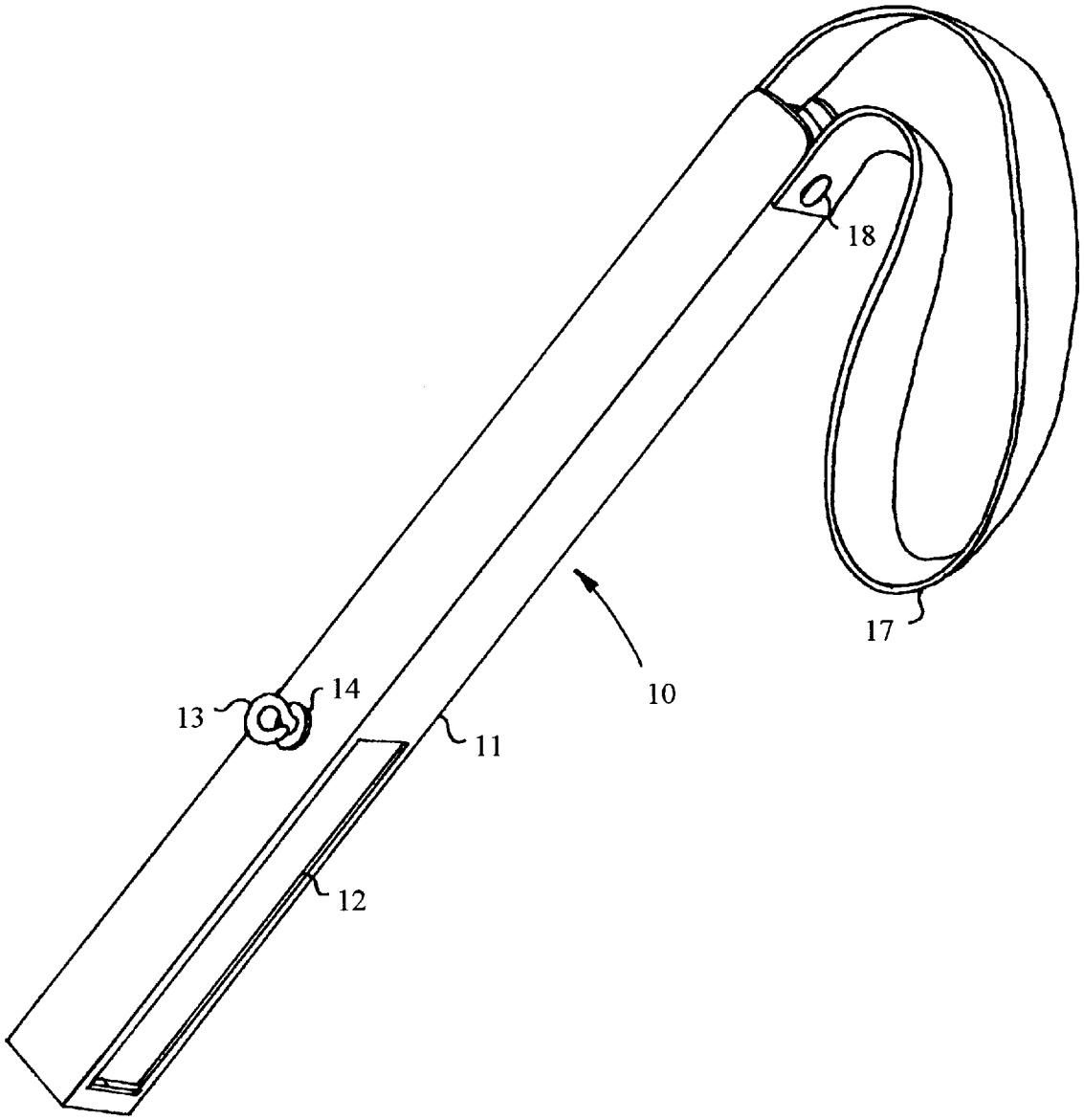
Figure 3A:
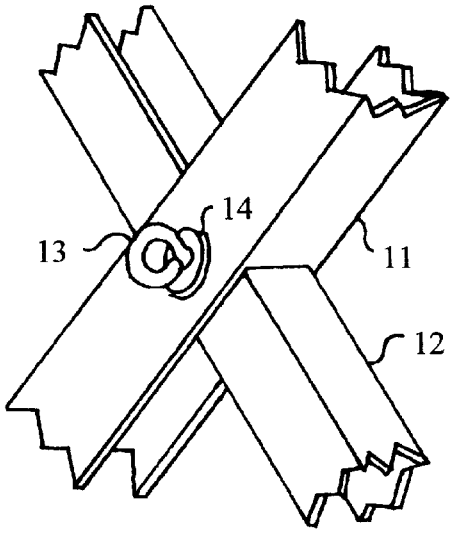
FIGS. 3A–3C are perspective, side and top views respectively of a backrest pivoting leg member attachment in accordance with the present invention.
Figure 3B:
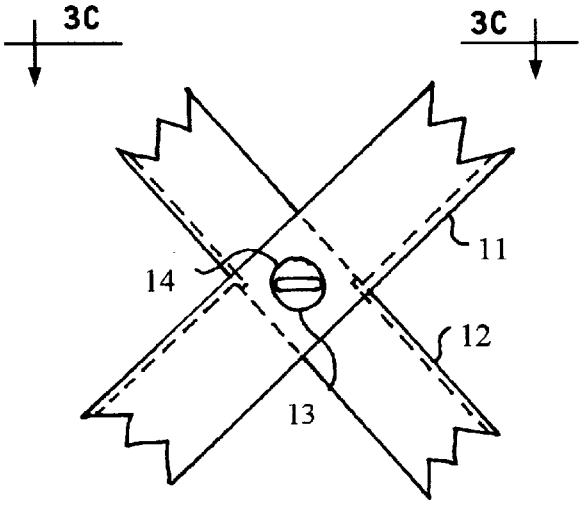
Figure 3C:
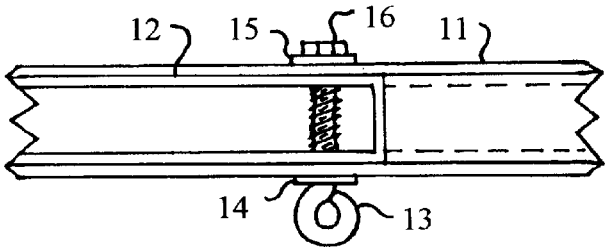
Figure 4A:
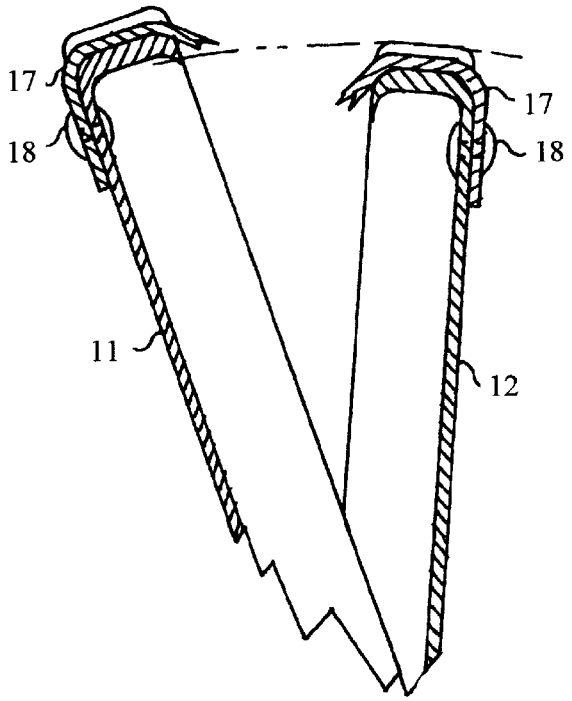
FIGS. 4A and 4B are side and end cross-section views respectively of a backrest upper leg member structure in accordance with the present invention.
Figure 4B:
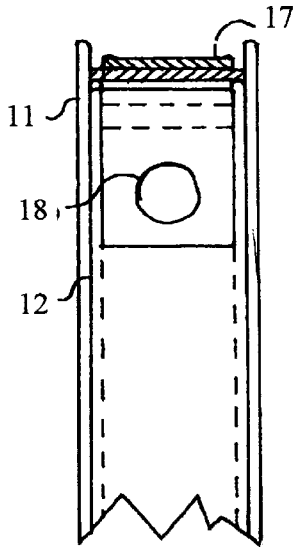
Figure 5A:
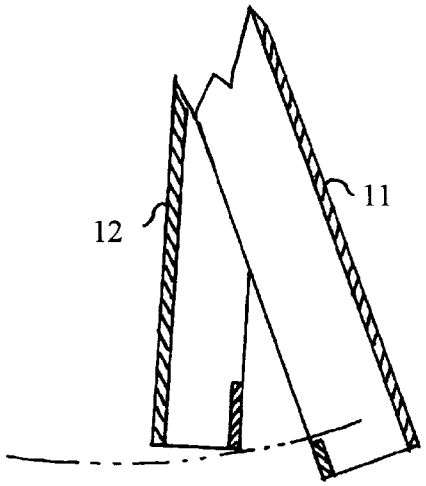
FIGS. 5A and 5B are side and end cross-section views respectively of a backrest lower leg member structure in accordance with the present invention.
Figure 5B:
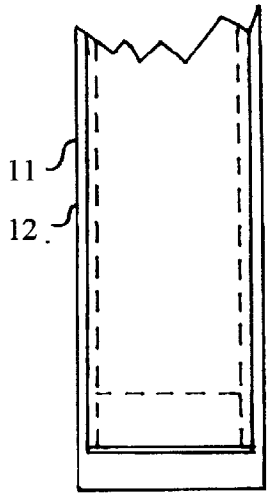

As illustrated in FIGS. 2A and 2B and again in more detail in FIGS. 3A, 3B and 3C, rest assembly 10 comprises two leg members preferably constructed of molded plastic or other such lightweight and durable material. An outside rest leg 11 (slightly larger) and an inside rest leg 12 (slightly smaller) are pivotally connected within the lower one-half of their length by an eye bolt 13 positioned through eye bolt washers 14 and 15 and secured with an eye bolt nut 16. This eye bolt connection arrangement is designed to provide a leg pivoting mechanism and concurrently act as an attachment site for connection strap 22. Torso support 17 is preferably a strap made of nylon or other such suitably strong and flexible material, attached at or near the top of each leg member by a torso support attachment 18. Also shown in FIG. 2B, and again in reference to FIGS. 4A, 4B, 5A and 5B, the smaller inside rest leg 12 nests completely within the larger outside rest leg 11 in the collapsed position. This arrangement provides a compact, yet structurally sound rest leg assembly, capable of supporting a great deal of reclining body weight.

Figure 6A:
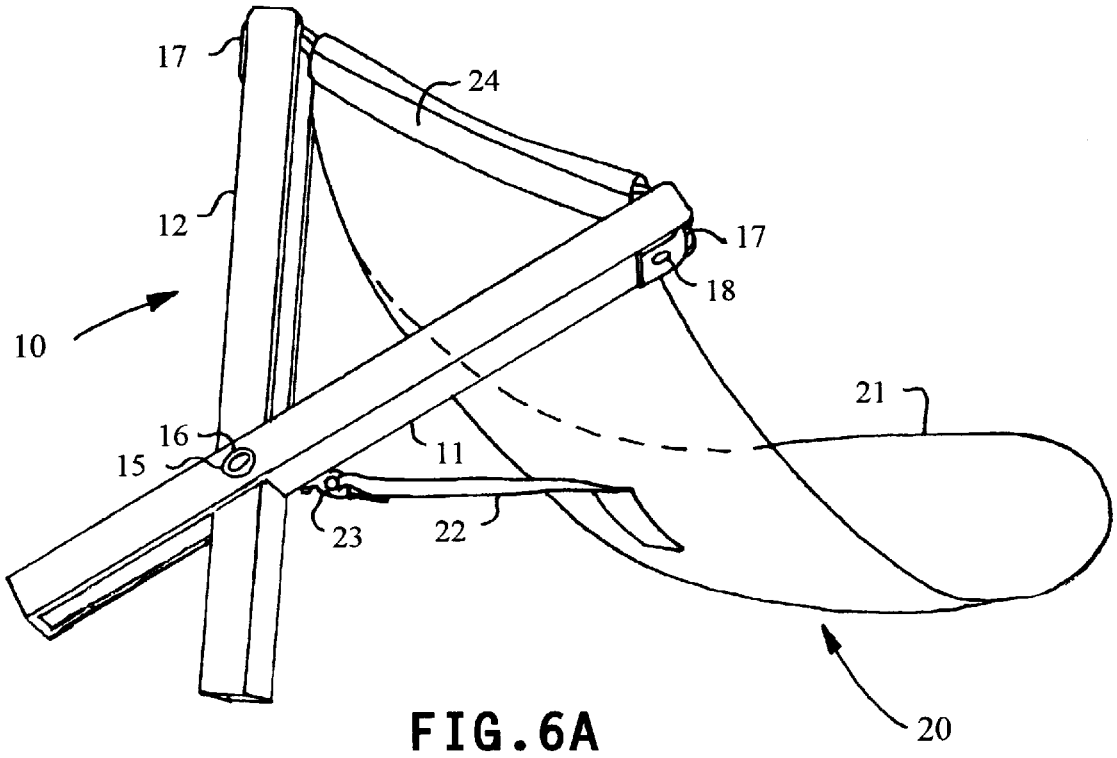
FIGS. 6B and 6B are perspective rear and side views respectively of a backrest with a lower back support assembly attached in accordance with the present invention.
Figure 6B:
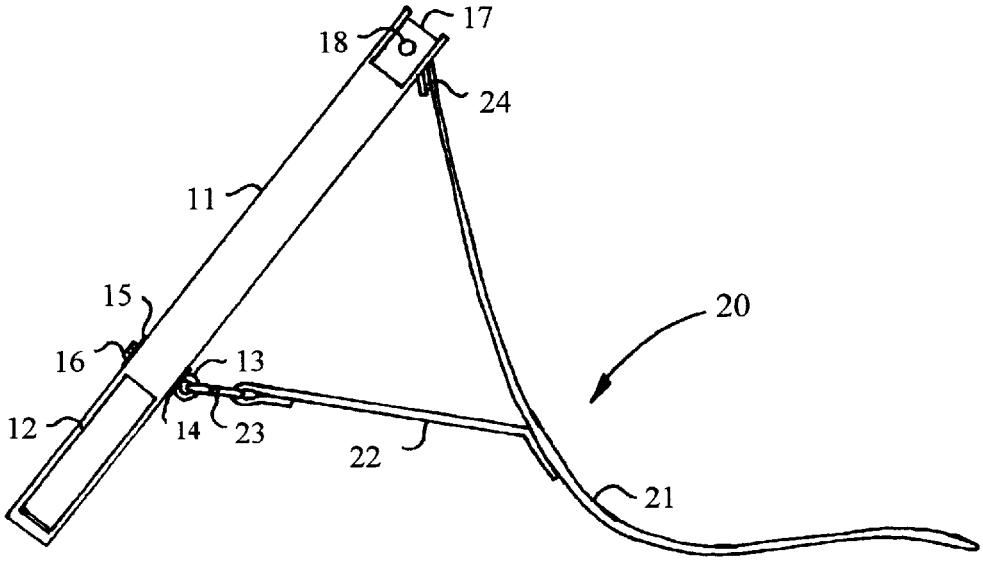
Figure 15:
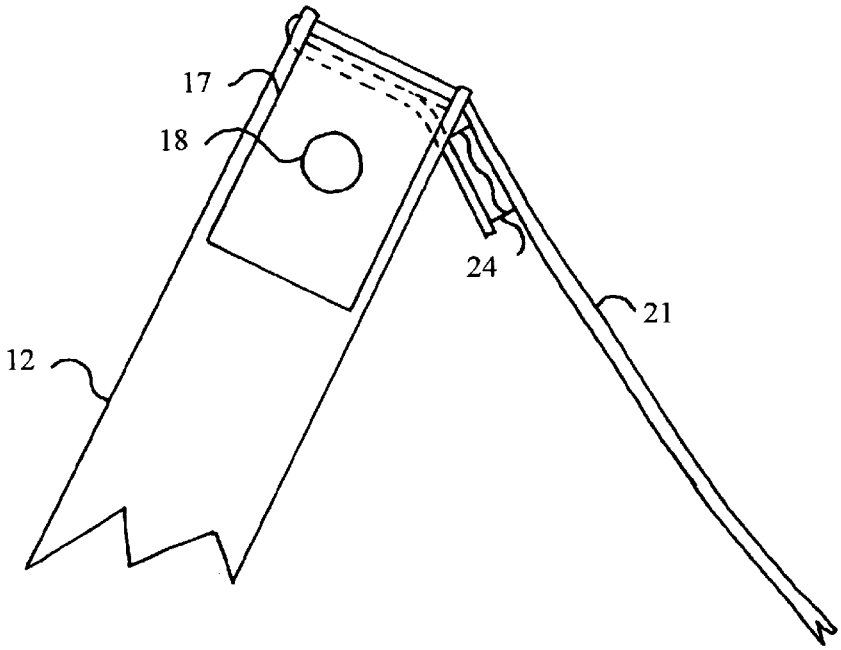
FIG. 15 is a side view of a lower back support assembly attachment to a backrest torso support in accordance with the present invention.

Referring to FIGS. 6A and 6B, a perspective view and a side view of rest assembly 10 are respectively shown in accordance with the present invention. Lower back support assembly 20 may be attached to rest assembly 10 by means of a lower back support attachment 24 that is preferably fixed in place around torso support 17 with the use of a Velcro-type strip or other such simple and secure attachment (this attachment is also shown in FIG. 15). With lower back support assembly 20 employed, lower back and torso support are provided. The preferably multi-layered lower back support assembly 20, may be used as a tote-type bag for transporting items to and from the desired site.

Figure 7A:
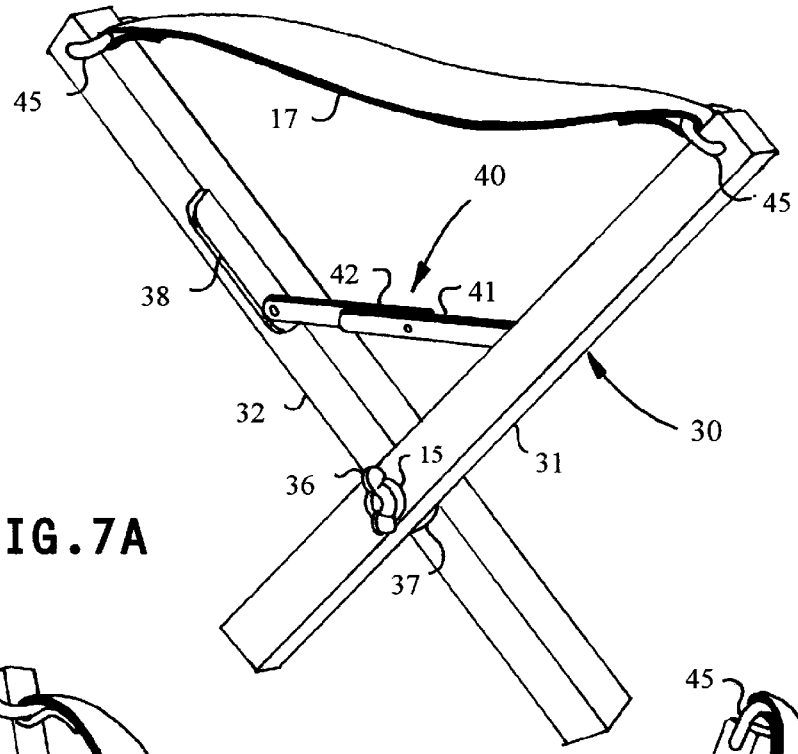
FIGS. 7A–7C are perspective views of an alternate backrest embodiment in the employed, half collapsed and collapsed positions respectively in accordance with the present invention.
Figure 7B:
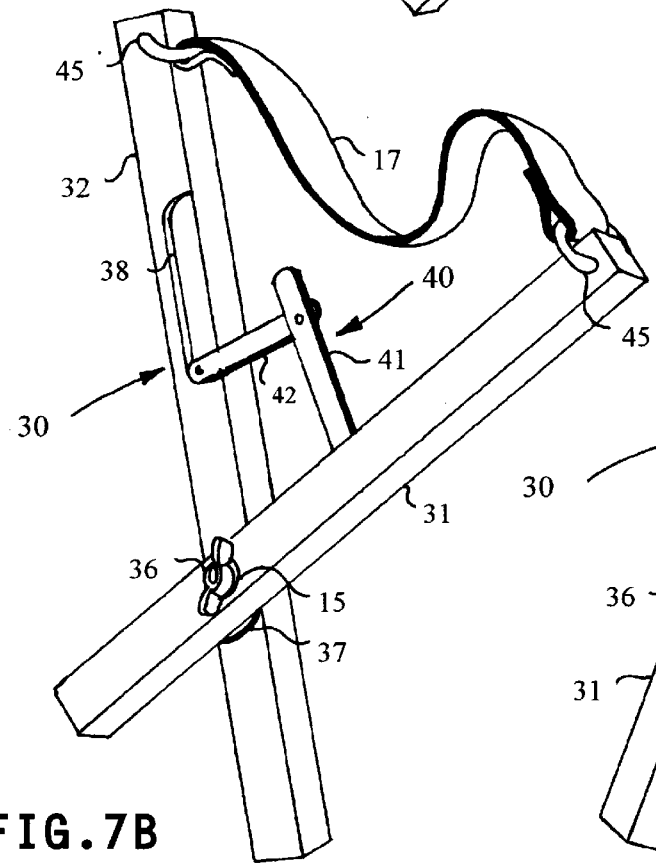
Figure 7C:
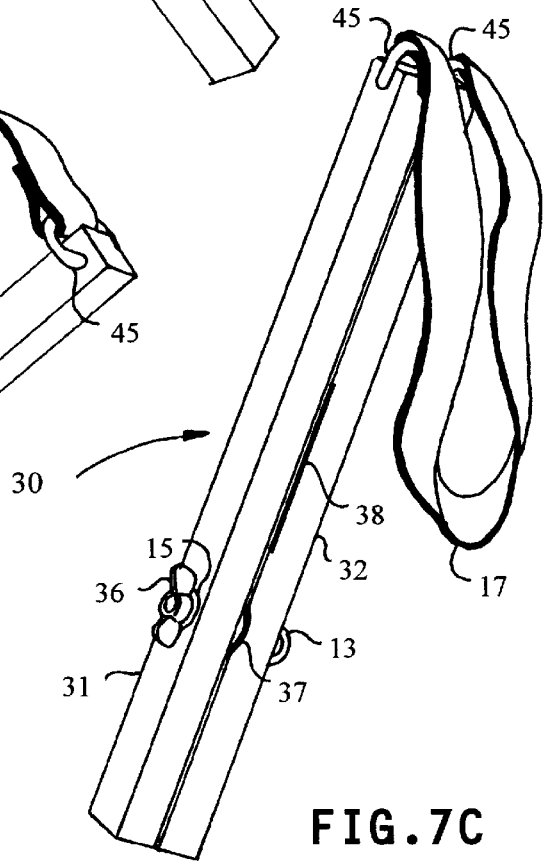
Figure 10:
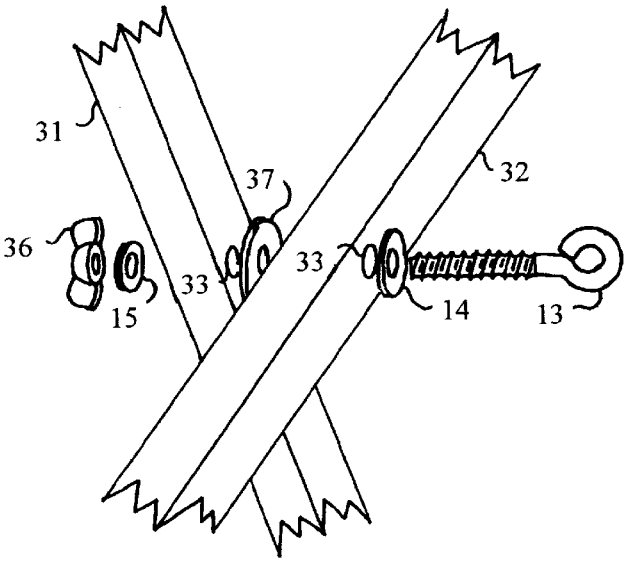
FIG. 10 is an exploded perspective side view of a pivoting leg member attachment of the rest of FIG. 7A in accordance with the present invention.

Referring to FIGS. 7A, 7B and 7C, perspective views of an alternate embodiment of a backrest in accordance with the present invention are shown. Alternate rest assembly 30 is illustrated in the employed and locked position in FIG. 7A, in the approximately half collapsed position in FIG. 7B and in the fully collapsed position in FIG. 7C. Alternate rest assembly 30 preferably comprises two leg members, a front rest leg 31 and a backrest leg 32. The leg members of this embodiment differ from those of rest assembly 10 in that they can be constructed of solid wood or other such strong and rigid material. The leg members may be connected alongside the other and collapse side by side rather than in the nesting configuration. The two leg members of rest assembly 30 are preferably pivotally connected within the lower one-half of their length. As illustrated in perspective exploded view of FIG. 10, the pivoting leg connection is shown in more detail with eye bolt 13 positioned through washer 14, followed by backrest leg 32, a leg spacer washer 37, installed to aid in rotational ease of the leg assembly, front rest leg 31, washer 15 and securing adjustable wing nut 36 which aids in securing the leg assembly in a desired position.

Figure 8A:
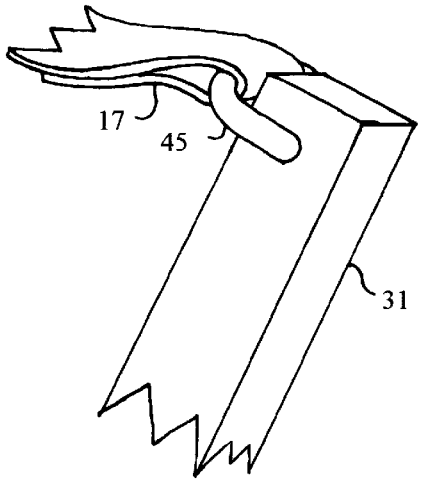
FIGS. 8A & 8B are side perspective and top views respectively of a torso support attachment of an alternate backrest embodiment of FIG. 7A in accordance with the present invention.
Figure 8B:
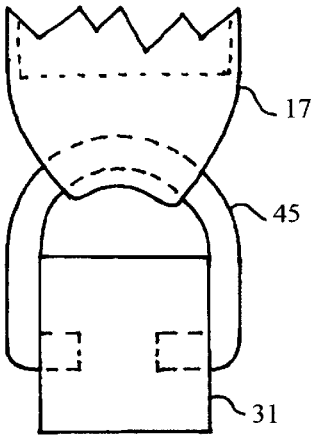

As detailed in FIGS. 8A and 8B, torso support 17 is preferable connected to the top of the two leg members of alternate rest assembly 30 by doubling the ends of the torso support material through a torso support D ring 45 and sewing or securely attaching the material. This support strap assembly is then secured to the leg members by inserting D rings 45 into pre-drilled holes in the top of each leg member.

Figure 9A:
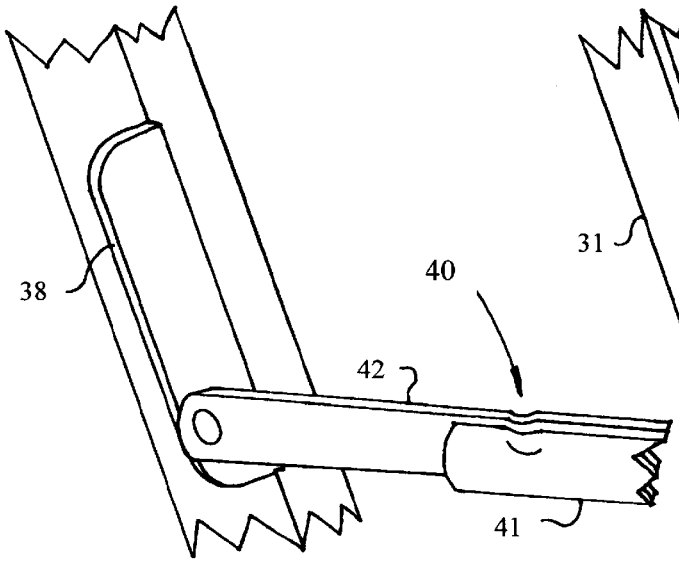
FIGS. 9A & 9B are perspective side and reverse views of a typical leg locking bracket attachment of the backrest embodiment of FIG. 7A in the fixed and half collapsed positions respectively in accordance with the present invention.
Figure 9B:
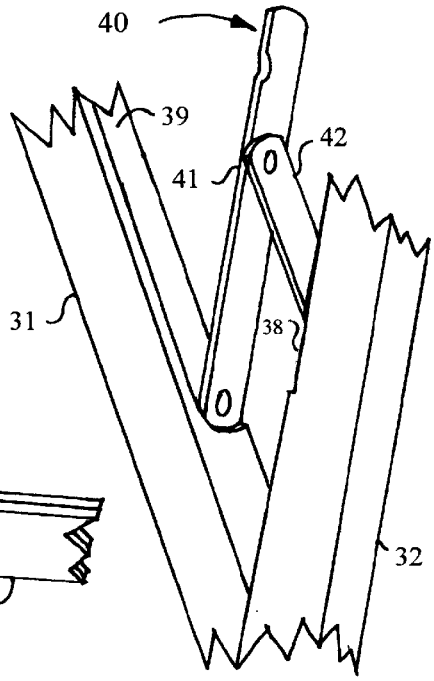

Referring to FIGS. 9A and 9B, a perspective side and reverse view of a locking leg brace assembly 40 in accordance with the present invention is shown connected to alternate rest assembly 30. Locking leg brace assembly 40 is mounted within routed cavities that accommodate its mass while in the collapsed position. A back locking brace cavity 38 is routed into the front side of back leg 32 and a front locking brace cavity 39 is routed into the rear side of front leg 31, with brace assembly 40 affixed to both leg members. A long locking brace arm 41 is secured to front leg 31 at the lower base of cavity 39 and a short locking brace arm 42 is secured to back leg 32 at the lower base of cavity 38.

Figure 11A:
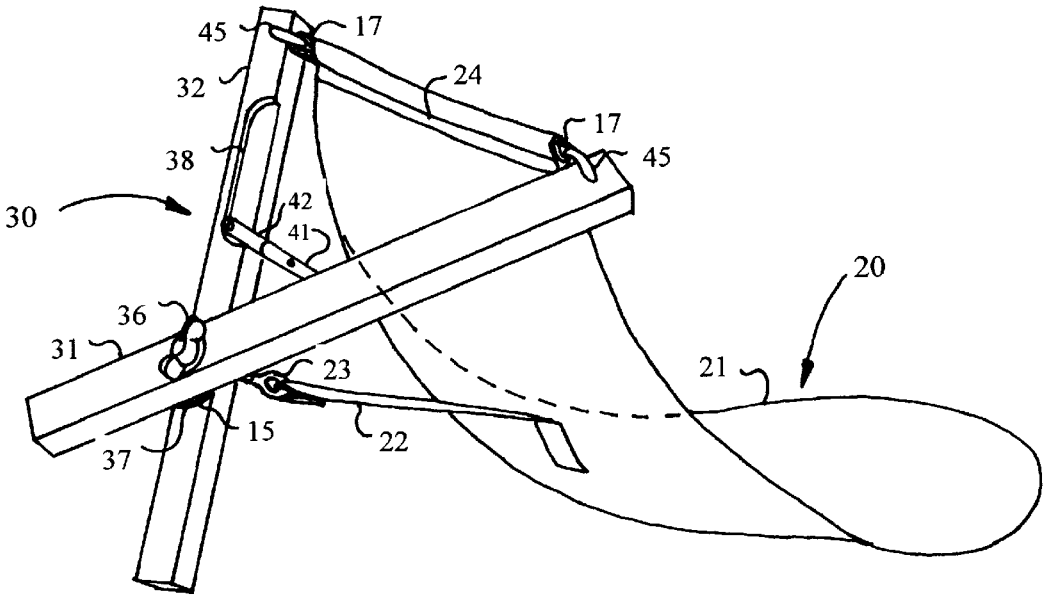
FIGS. 11A & 11B are perspective rear and side views respectively of an alternate backrest embodiment of FIG. 7A with a lower back support assembly attached in accordance with the present invention.
Figure 11B:
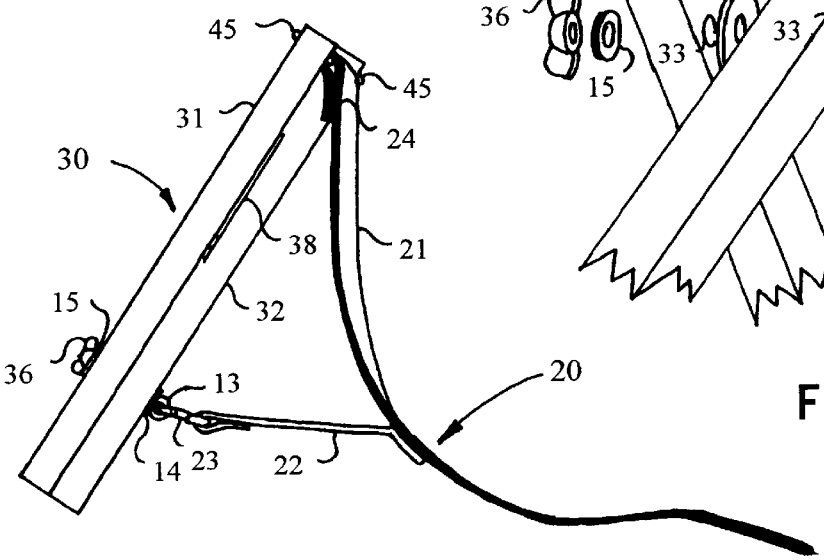

Optional lower back support assembly 20 can be installed and used with rest assembly 30 in the same manner as with rest assembly 10. This installation and positioning is illustrated in FIGS. 11A and 11B.

Figure 12A:
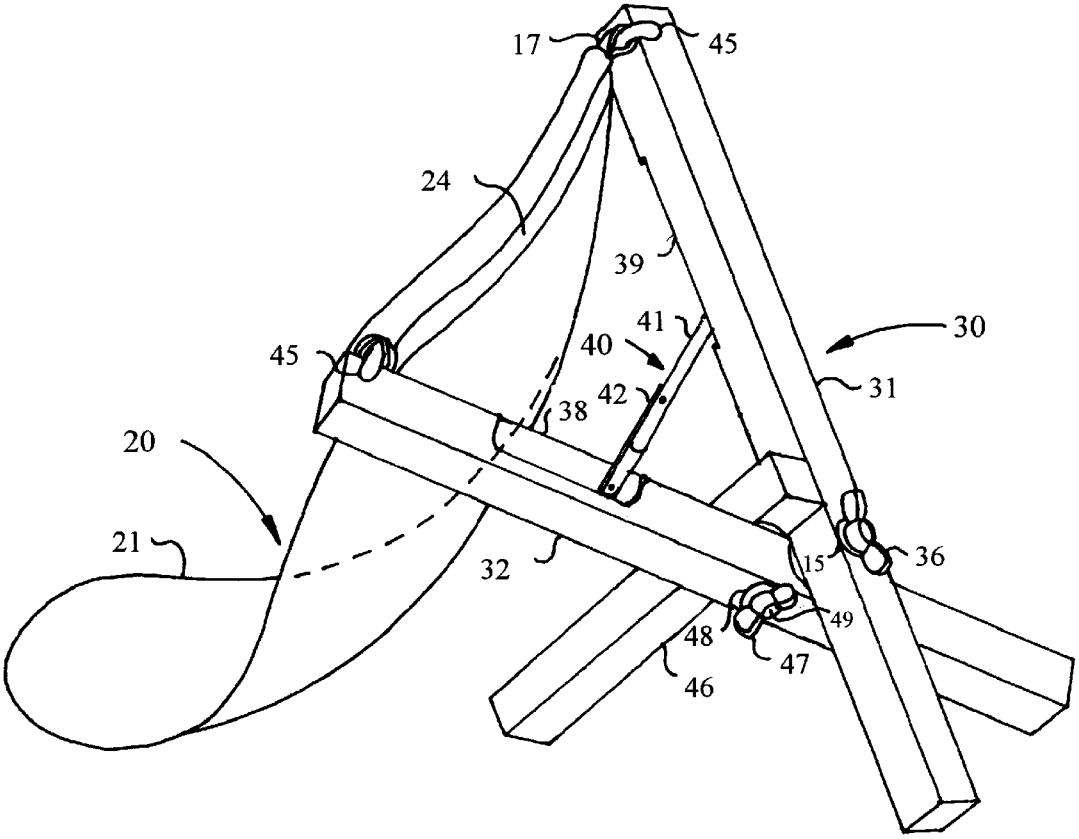
FIGS. 12A & 12B are perspective views of the backrest embodiment of FIG. 7A with a pivoting rest brace in the employed and non-employed positions respectively in accordance with the present invention.
Figure 12B:
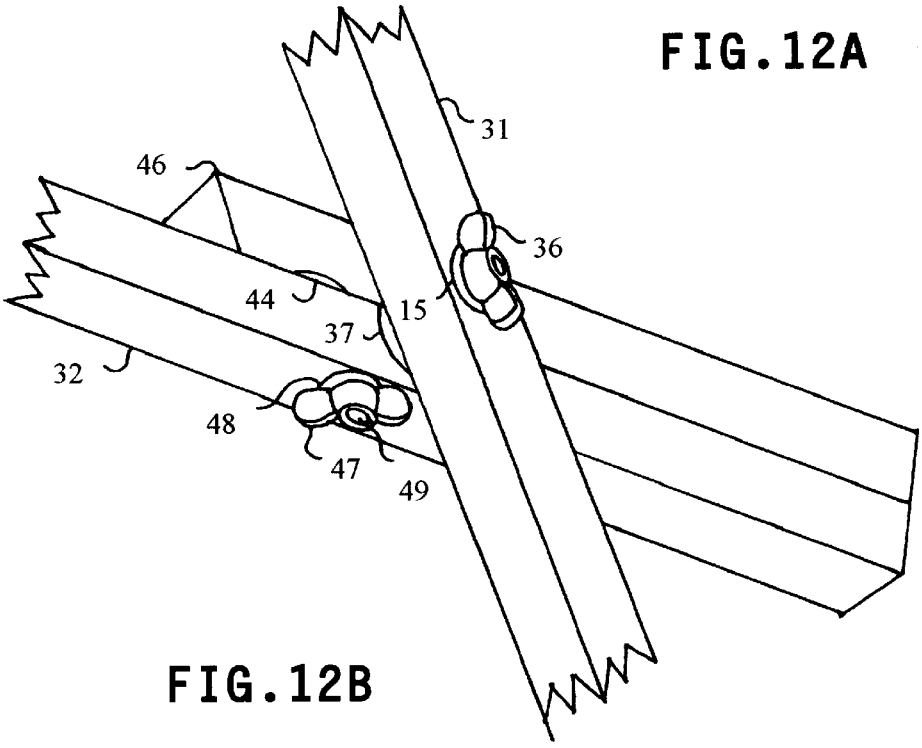

Yet another embodiment of the present invention includes installation and use of an optional pivoting rest brace 46 to add additional rest stability, as shown in FIGS. 12A and 12B. Brace 46 is secured to leg 32 and is rotatable from a perpendicular to a parallel orientation relative to leg 32. Typically, brace 46 is secured with a brace machine bolt 49 installed though brace 46, a brace space washer 44, back leg 32, a pivoting brace washer 48 and an adjustable pivoting brace wing nut 47.

Figure 13A:
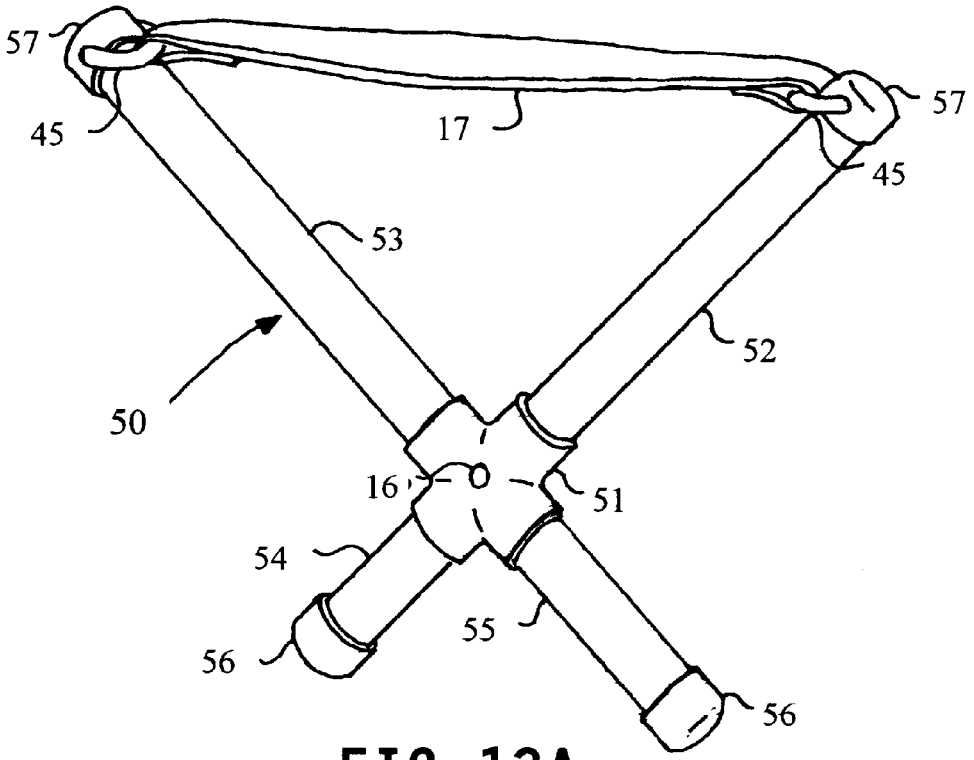
FIGS. 13A & 13B are perspective views of a second alternate backrest embodiment in the employed and collapsed positions respectively in accordance with the present invention.
Figure 13B:
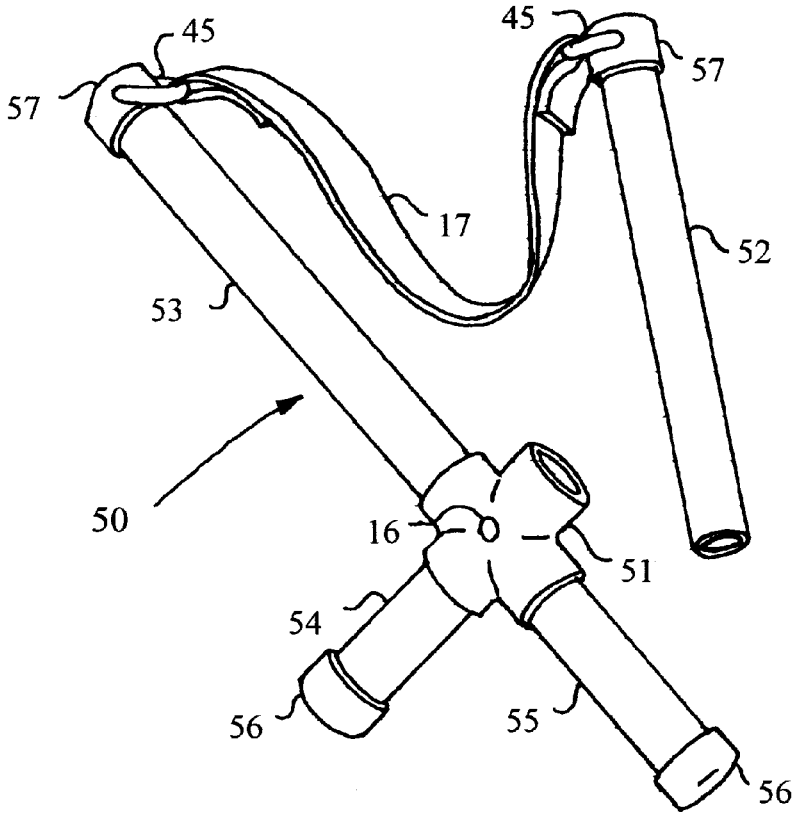

Referring to FIGS. 13A and 13B, another embodiment of a backrest in accordance with the present invention is shown. This backrest (identified with reference numeral 50) is a collapsible, non-rotatable leg assembly unit, preferably comprising a leg connector 51 into which a right upper leg member 52, a left upper leg member 53, a left lower leg member 54 and a right lower leg member 55 are inserted and secured. Lower leg caps 56 are positioned onto the lower legs and form the feet of the rest assembly, while upper leg caps 57 are positioned onto the upper legs. These legs, caps and connector are preferably made of plastic or other such lightweight, rigid and durable material. Torso support 17 can be connected to the upper leg caps by D rings 45 in the same manner as described above with reference to alternate rest assembly 30. D rings 45 are secured through pre-drilled holes through leg caps 57. Rest assembly 50 collapses into a compact transport bundle by removing one or more of the plastic leg members from leg connector 51 as shown in FIG. 13B.

Lower back support assembly 20 can be installed and used with rest assembly 50 in the same manner as discussed above for backrest assemblies 10 and 30.

Figure 14A:
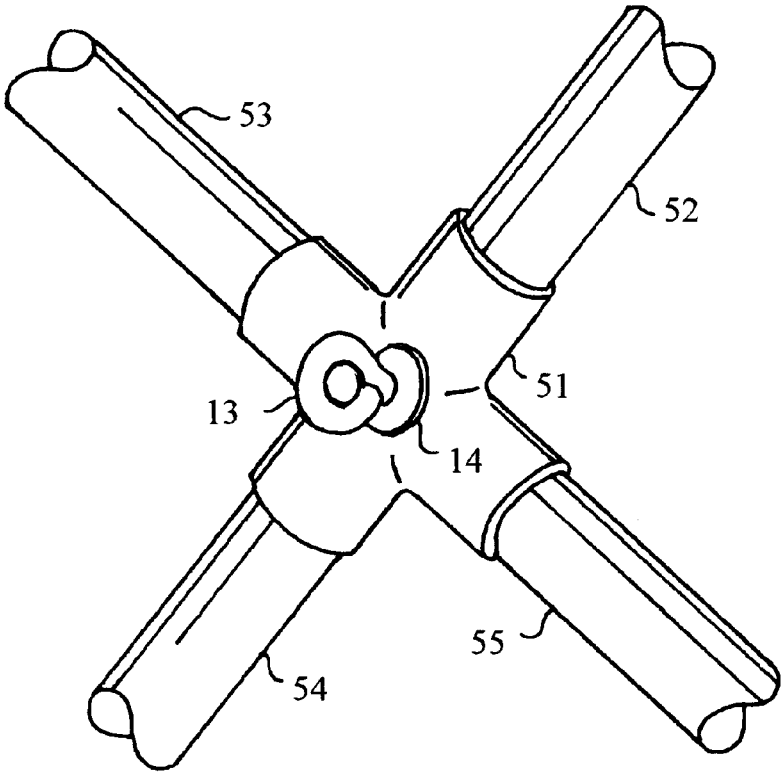
FIGS. 14A & 14B are a perspective and side view respectively of the leg attachment member of the second alternate backrest embodiment of FIG. 13A in accordance with the present invention.
Figure 14B:
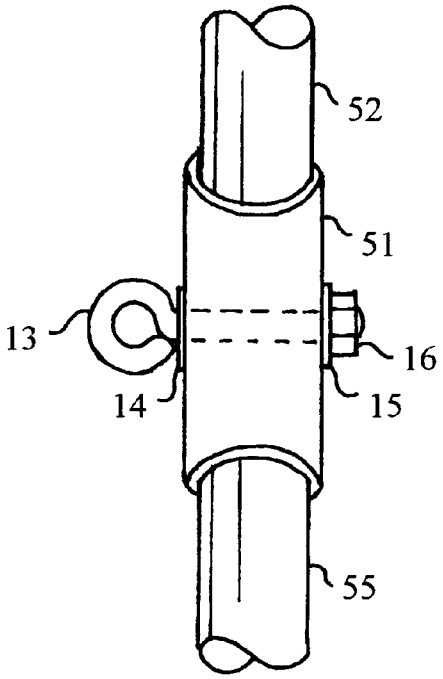

Typical installation of eye bolt 13 to leg connector 51 is detailed in FIGS. 14A and 14B. Eye bolt 13 is inserted through washer 14, leg connector 51 and washer 15 and secured with nut 16.

From the description above, most advantages of the present invention become evident. These include, but are not limited to the following:

(1) The crossing leg member support and back support mechanisms of this rest assembly provides a simple, lightweight, comfortable and durable device for supporting a reclining user;

(2) The reclining stability and support strength of the crossed leg arrangement is enhanced when reclining body weight is applied;

(3) The collapsible design of this rest provides a compact transport unit that is easy to assemble and use;

(4) The molded plastic leg members can be inexpensively manufactured permitting this rest assembly to be cost-effectively manufactured;

(5) The use of plastic permits the rest assembly to be made in different colors, improving the overall aesthetics;

(6) The optional lower back support assembly can be used for additional back support and rest stability; and (7) The optional lower back support assembly is preferably freely detachable and thus can be used for other functions such as transporting necessary sunbathing supplies or other recreational equipment.

Operation of the Invention

The overall lightweight and compact design of this reclining backrest makes it possible to take the unit when traveling or for an outing. The fully collapsed, preferred embodiment consisting of rest assembly 10 wrapped with optional lower back support assembly 20 can be carried to and from the rest site by simply placing the flexible torso support 17 over the shoulder, leaving the hands free for other needs. If the need arises, the lower back support assembly can be used to transport other equipment or materials to or from the rest site. The lower back support assembly can be removed from the rest assembly by uncoupling back support connection strap 22 from lower back support material 21 and unwrapping the lower back support assembly from around the collapsed rest assembly. Necessary items may be placed within the tote bag feature of the lower back support assembly. The lightweight design of the rest makes it possible to carry the unit a great distance with ease. When arriving at the preferred rest site, remove the lower back support assembly as described above (if it is not being used as a tote bag) and grasp the fully closed rest assembly as illustrated in FIG. 2B. With the left hand holding the torso support where it meets outside rest leg 11 and the right hand holding the torso support where it meets inside rest leg 12, gently pull the legs apart, opening the leg members of the rest assembly. When the rest legs are opened and the torso support is taut, as shown in FIG. 2A, direct the lower legs of the rest assembly into the sand (or other substance that impedes movement). A user should then sit in front of the rest, facing away from torso support 17 and lean backwards until their back is supported just below the shoulder blades by the torso support.

If the lower back support assembly is being used for additional reclining support, it should be attached to the rest assembly by affixing the Velcro-type lower back support attachment 24 around the torso support, as shown in FIG. 15, and draping the lower back support material onto the sitting surface in front of the rest. Connection strap 22 may be fastened through connector 23 to eye bolt 13 as shown in FIGS. 6A and 6B. A user may then sit in front of the rest facing away from the torso support and lean back until the upper back is supported just below the shoulder blades by the torso support. The lower back assembly (as shown in FIG. 1A) then supports the lower back.

To close or collapse the rest in preparation for transport or storage, disconnect the back support connection strap by uncoupling connector 23. Release the lower back support attachment by pulling apart the Velcro-type fastener. While holding the rest assembly in the left hand, grasp the center of the torso support with the right hand and lift directly up and away from the rest legs, thus closing or collapsing the rest assembly. Roll the lower back support assembly around the completely collapsed rest assembly and secure with the back support connection strap and connector, as shown in FIG. 1C. The rest unit can then be carried or hung in storage by the torso support.

Operation of alternate rest assembly 30 is similar to that of rest assembly 10 and differs only in the locking action of the leg members. When opening and securing alternate rest assembly 30, loosen eye bolt wing nut 36 allowing the leg members to move freely. Grasp front leg 31 near the top with the left hand and grasp back leg 32 near the top with the right hand, gently pull the two leg members apart at the top. When the leg members are employed and torso support 17 is taut, push downward on leg locking brace assembly 40 forcing long locking brace arm 41 and short locking brace arm 42 into a parallel orientation, Tighten the eye bolt wing nut and proceed with installation of the lower back support assembly if desired.

To close or collapse the alternate rest assembly, remove the lower back support assembly, loosen the eye bolt wing nut, pull up on the center of the leg locking brace assembly and unlock the assembly. Pull the torso support up and away from the leg members, closing the rest. When the rest legs are collapsed in the parallel position and the leg locking brace assembly is withdrawn into the provided locking brace cavities, tighten the eye bolt wing nut to secure the closed leg members and proceed as with rest assembly 10.

Operation of second alternate rest assembly 50 is somewhat different from that of either of the two previously discussed assembly embodiments in that there is no pivoting of the leg members. To assemble, insert all four leg members into leg connector 51, as shown in FIG. 13A, thus providing a rigid and secure rest assembly. Proceed with installation of the lower back support assembly if desired as previously described.

To close or collapse the second alternate rest assembly, remove either of the upper leg members from the leg connector and place along side the other leg member, as shown in FIG. 13B. Additional disassembly can be achieved by also removing the opposite lower leg member from the leg connector, providing a more streamlined transport package. The lower back support assembly can then be bound around the disassembled rest assembly as previously described.

Ramifications and Scope of the Invention

While this invention and its various embodiments have been described in some detail in both the drawings and written descriptions, it will be self evident to one skilled in the art that various changes or modifications in the invention's form or detail could be made without substantially departing from the obvious spirit or scope of the invention. For example, the leg members of the various rest embodiments could be constructed in various dimensions, shape or of different materials or modified to increase or improve structural stability, each of which may result in or require minor variations in the overall design. The leg members could be attached or hinged in many other fashions, for example, utilizing metal or synthetic hinge pins or bolts or an appropriate interlocking mechanism engineered into the plastic leg members themselves, achieving the same or similar action. The torso support could be made of different materials, padded or uniquely shaped to provide improved comfort to the user. The final shape and material of the optional lower back support assembly could vary depending on the cost of production or new materials becoming available or use of a padded material to provide additional reclining comfort on hard surfaces. Pockets, pouches, straps and handles could be affixed to the lower back support assembly for additional or secured storage or ease of handling. The attachment of the lower back support assembly to the torso support could be achieved in many other fashions, for example, utilizing snaps, buttons, zippers, string ties or the support assembly could be attached directly to the leg members themselves. The lower back support assembly could be permanently attached to the torso support or leg members rather than be removable. Thus the overall scope of this invention should be determined and maintained by the appended claims and their legal equivalents rather than by the specific examples provided.

I claim:

1. A backrest apparatus, comprising:

a back support strap configured to receive at least a portion of a back of a person in the sitting or reclining position;

a collapsible support structure having a bottom and a top, said back support strap being securely fastened to said collapsible support structure proximate the top thereof and defining a maximum expansion of said collapsible support structure in an open position; and a backrest member that is releasably, yet positively coupled to said back support strap and configured to extend downward therefrom to receive and support a sitting human when in use;

wherein said support structure is configured to be substantially non-freestanding, said structure providing support in said open position by virtue of placing said bottom in or on a substance where movement is impeded and having a user lean against said back support strap.

2. The apparatus of claim 1, wherein said backrest member is configured to provide lower back support to a user.

3. The apparatus of claim 2, wherein said backrest member, proximate to said area of lower back support, is coupled to said collapsible support structure between said top and bottom thereof.

4. The apparatus of claim 3, wherein said lower back support area is releasably coupled to said collapsible support structure.

5. The apparatus of claim 1, wherein said collapsible support structure includes a first leg member and a second leg member, said first and second leg members being configurable into a generally intersecting manner.

6. The apparatus of claim 5, wherein said first and second leg members are movable between said open position in which said back support strap is extended and a closed position in which a substantial portion of said first leg member fits inside said second leg member.

7. The apparatus of claim 1, wherein said backrest member includes a pocket.

8. A backrest apparatus, comprising:

first and second legs substantially in an intersecting arrangement when in use;

a back support member configured substantially as a strip coupled between said first and second legs; and a lower back support member that is releasably attached to said back support member.

9. The apparatus of claim 8, wherein said lower back support member includes a pocket.

10. The apparatus of claim 8, wherein said lower back support member is individually coupled to said first and second legs between a top and bottom thereof.

11. A backrest apparatus, comprising:

a back support strap configured to receive at least a portion of a back of a person in the sitting or reclining position;

a collapsible support structure having a bottom and a top, said back support strap being securely fastened to said collapsible support structure proximate the top thereof and defining a maximum expansion of said collapsible support structure in an open position; and a backrest member coupled to said back support strap and configured to extend downward therefrom to receive and support a sitting human when in use and to provide lower back support;

wherein said support structure is configured to be substantially non-freestanding, said structure providing support in said open position by virtue of placing said bottom in or on a substance where movement is impeded and having a user lean against said back support strap; and wherein said backrest member, proximate to said area of lower back support, is coupled to said collapsible support structure between said top and bottom thereof.

12. The apparatus of claim 11, wherein said lower back support area is releasably coupled to said collapsible support structure.

* * * * *